US006810828B2

(12) United States Patent
Maklezow

(10) Patent No.: US 6,810,828 B2
(45) Date of Patent: Nov. 2, 2004

(54) TUBULAR COMPARTMENTALIZED INTEGRATED HULL CONSTRUCTION

(76) Inventor: Viktor Maklezow, 5801 France Rd., New Orleans, LA (US) 70126

( * ) Notice: Subject to any disclaimer, the term of this patent is extended or adjusted under 35 U.S.C. 154(b) by 0 days.

(21) Appl. No.: 10/356,822

(22) Filed: Feb. 3, 2003

(65) Prior Publication Data

US 2004/0149197 A1 Aug. 5, 2004

(51) Int. Cl.[7] ..... B63B 5/24
(52) U.S. Cl. ..... 114/357; 114/81
(58) Field of Search ..... 114/357, 356, 114/68, 81, 65 R

(56) References Cited

U.S. PATENT DOCUMENTS

| | | | | |
|---|---|---|---|---|
| 2,593,714 A | * | 4/1952 | Robinson | 156/156 |
| 3,093,847 A | * | 6/1963 | Strecker | 114/357 |
| 3,312,579 A | | 4/1967 | Heifetz | |
| 3,556,448 A | | 1/1971 | Dobbs | |
| 3,575,251 A | | 4/1971 | Moore | |
| 4,090,002 A | | 5/1978 | Rosenblum | |
| 4,223,053 A | | 9/1980 | Brogan | |
| 4,789,577 A | | 12/1988 | Leone et al. | |
| 5,107,782 A | | 4/1992 | Frederick | |
| 5,522,340 A | | 6/1996 | Skogman | |

* cited by examiner

*Primary Examiner*—Sherman Basinger
(74) *Attorney, Agent, or Firm*—Wyatt, Tarrant & Combs, LLP

(57) ABSTRACT

An integrated, compartmentalized, water impermeable hull that is constructed of a plurality of lengthwise tubes. The tubes are arranged in a generally parallel relation to one another such that an outer surface of each tube abuts an outer surface of at least one other of the tubes. The tubes are sandwiched between a first inner support layer and a second inner support layer. Each inner support layer undulates along and fixedly adheres to the tubes to thereby hold the tubes in a fixed relation to one another. First and second outer support layers are positioned over the first and second inner support layer, respectively, and are fixed to a plurality of peaks of the first inner support layers to thereby reinforce the first inner support layers.

26 Claims, 6 Drawing Sheets

TUBULAR COMPARTMENTALIZED INTEGRATED HULL CONSTRUCTION

CROSS REFERENCE TO RELATED APPLICATIONS

Not applicable

STATEMENT REGARDING FEDERALLY SPONSORED RESEARCH OR DEVELOPMENT

Not applicable

REFERENCE TO A MICROFICHE APPENDIX

Not applicable

FIELD OF THE INVENTION

The present invention relates to vessel hull construction, and more particularly to a compartmentalized, integrated hull constructed from tubing, such as PVC tubing.

BACKGROUND OF THE INVENTION

It is well known that binding two separate rigid surface panels onto opposite sides of a core material provides a structure with superior strength and stiffness, as well as a good strength-to-weight ratio. One example is corrugated cardboard, which uses two pieces of flat cardboard sandwiched around a core of waved or undulated cardboard. The individual pieces of cardboard are thin and weak, but when bonded together in the foregoing arrangement, they form a solid structure that can be used to form boxes and other items having substantial stiffness and rigidity.

Taking advantage of the foregoing principle, the hulls of many ships and boats are made of fiber-resin laminated on opposite sides of a core of foam or end-grain balsa wood. The fiber-resin laminate consists of a fiber reinforcing material and a resin. The most commonly used fiber reinforcing materials are fiberglass, kevlar, and carbon. The most commonly used resins are epoxy, polyester, and vinylester.

As far as the inventor, who has been building boats for several decades, is aware, no efforts have been made to build a hull or other structure using the core material and techniques disclosed herein. The closest prior art of which the inventor is aware is U.S. Pat. No. 5,522,340 (Skogman) for vessels having a double-walled laminated frame. Skogman discloses a vessel wall core consisting of a woven structure. The weft of the woven structure is a plurality of cylindrical members. The cylindrical members are made of polyurethane foam piping, polyethylene foam piping, or minute polyvinyl tubing having an outside diameter of 3/16 inch. The warp of the weave consists of fiberglass parallel fibers. The woven structure is enclosed between a pair of outer walls. The cylindrical members are separated by the weave. The woven structure is complex, and would be difficult to employ in boat building. Other prior art patents that may be interest are U.S. Pat. No. 3,312,579 (Heifetz); U.S. Pat. No. 3,556,448 (Dobbs); U.S. Pat. No. 3,575,251 (Moore); U.S. Pat. No. 4,090,002 (Rosenblum); U.S. Pat. No. 4,223,053 (Brogan); U.S. Pat. No. 4,789,577 (Leone); and U.S. Pat. No. 5,107,782 (Frederick), but none of these patents disclose the barrier construction described in the present application.

OBJECTS AND SUMMARY OF THE INVENTION

It is an object of the invention to provide a vessel hull that has superior strength, is economical to manufacture, is virtually unsinkable due to compartmentalized construction, as well as methods of barrier construction that can be readily and efficiently employed to construct customized boats.

Accordingly, the invention disclosed herein is an integrated, compartmentalized, water impermeable hull for a water vessel such as a boat that is constructed of a plurality of lengthwise tubes, such as PVC, ABS, or plastic tubes. The plurality of lengthwise tubes are arranged in a generally parallel relation to one another such that an outer surface of each tube abuts an outer surface of at least one other of the tubes. The tubes are sandwiched between a first inner support layer and a second inner support layer. Each inner support layer undulates along and fixedly adheres to the tubes to thereby hold the tubes in a fixed relation to one another. The undulations preferably form an angle of between about 120 degrees and about 150 degrees relative to one another. A first outer support layer is positioned over the first inner support layer, and is fixed to a plurality of peaks of the first inner support layer to thereby reinforce the first inner support layer. A second outer support layer is positioned over the second inner support layer, and is fixed to a plurality of peaks of the second inner support layer to thereby reinforce the second inner support layer. Together, the tubes, the first and second inner support layers, and the first and second outer support layers are configured to form the integrated, compartmentalized, water impermeable hull.

Individual barriers having the foregoing construction can be used for various structural purposes, such as vessel sidewalls, bulkheads, walls, and decks. The individual barriers can be joined together to form a vessel.

In order to provide economical construction, the tubes and fiber resin preferably consist of readily available components. The tubes are preferably PVC or ABS tubes. The first and the second inner support layers and the first and the second outer support layers consist of a fiber-resin laminate. The fiber component of the fiber-resin laminate is preferably fiberglass, kevlar, or carbon. The resin component of the fiber-resin laminate is preferably epoxy, polyester, or vinylester. In order to provide for the construction of large boats using conventionally available lengths of tubing, the invention discloses methods for joining tubes end-to-end to thereby form a lengthened barrier.

The invention includes several features for enhancing the buoyancy and safety of the hull in the event of a puncture. The open ends of the tubes can be sealed with polyurethane foam, such that each tube forms an individualized compartment. In order to compartmentalize tubes that have been joined end-to-end, the invention includes a baffle member that can be readily inserted into the juncture between end-to-end connections of tubes. By providing compartments within lengthened tubes, the invention provides for increased buoyancy and safety of the hull in the event of a puncture of the hull.

The tubular construction provides other benefits besides strength, economy and buoyancy. The tubes can be used to run water, wiring, air conditioning, and the like. The tubes can also be used for tankage and for balast. Methods of fabricating the foregoing structures are disclosed.

The foregoing and other objects, features, aspects and advantages of the invention will become more apparent from the following detailed description of the invention when considered in conjunction with the accompanying drawings.

PREFERRED EMBODIMENTS OF THE INVENTION

Figure 1:
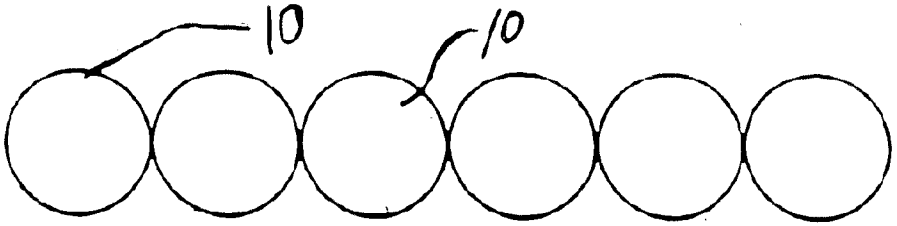
FIG. 1 shows an end view of a plurality of PVC tubes aligned to form a barrier, prior to applying layers of fiber resin.
Figure 3:
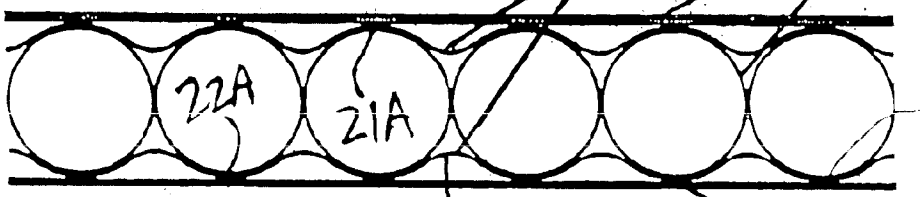
FIG. 3 shows an end view of the plurality of PVC tubes of FIG. 2 after application of a first and second outer reinforcement layer over the first and second inner reinforcing layers, respectively.

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention. As shown in FIGS. 6, 7, 8, and 10, the invention is a tubular, integrated, compartmentalized, water impermeable hull for a water vessel such as a boat. As shown in FIG. 3, the hull is constructed from a plurality of lengthwise tubes 10. As shown in FIG. 1, the tubes 10 are arranged such that an outer surface of each tube abuts an outer surface of at least one other of the tubes 10 to thereby form a substantially continuous barrier of the tubes 10. As indicated in the drawing figures, when used to form the side walls of the hull of a vessel, the tubes 10 are preferably arranged substantially parallel to the waterline, rather than in a vertical orientation, and are arranged in a generally bow-to-stern orientation.

Figure 2:
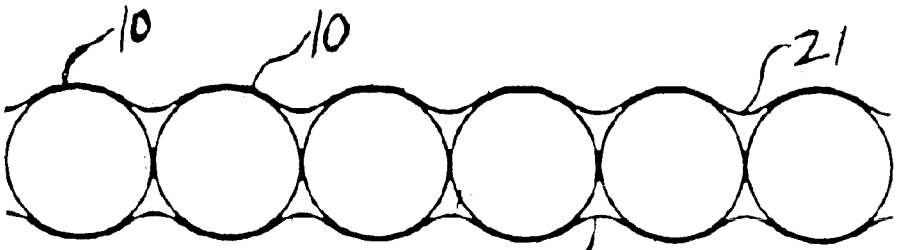
FIG. 2 shows an end view of the plurality of tubes of FIG. 1 after application of a first and a second inner reinforcement layer of fiber resin.

As shown in FIG. 2, the tubes 10 are sandwiched between a first inner support layer 21 and a second inner support layer 22. As shown most clearly in FIGS. 2 and 3, each inner support layer 21, 22 undulates along and fixedly adheres to the tubes 10 to thereby hold the tubes 10 in a fixed relation to one another. The undulation between each peak is preferably gentle, with an angle of between about 120 to 150 degrees between adjacent undulations, and preferably of about 135 degrees (see end view of FIGS. 2 and 3).

Figure 4:
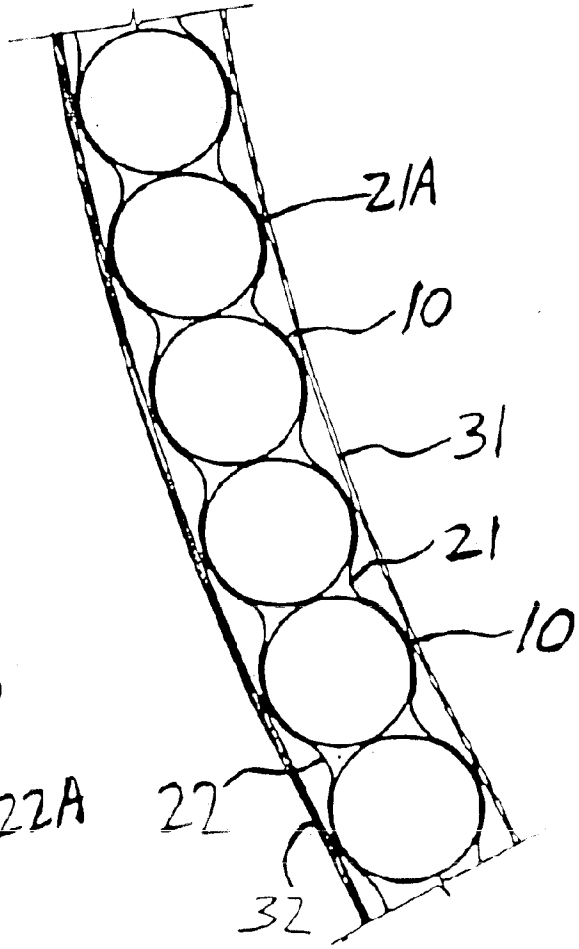
FIG. 4 shows an end view of a wall construction of the invention, the wall having a curved dimension, such as of the type found on the hull of a boat.
Figure 5:
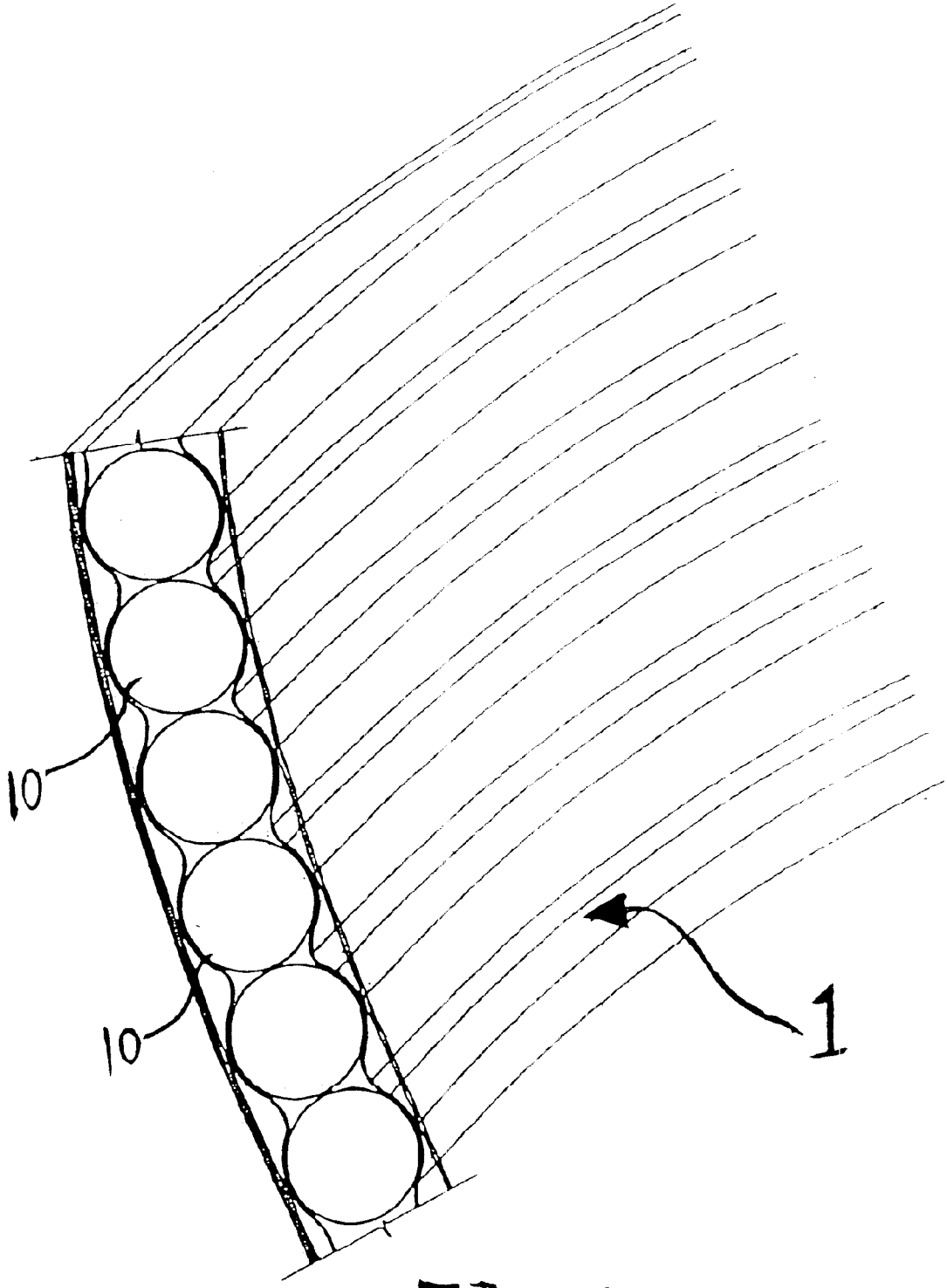
FIG. 5 is a cross-section side perspective view of a boat hull formed using the wall construction of the invention.

As shown in FIG. 3, a first outer support layer 31 is positioned over the first inner support layer 21. The first outer support layer 31 is fixed to a plurality of peaks 21A of the first inner support layer to thereby reinforce the first inner support layer 21. Likewise, a second outer support layer 32 is positioned over the second inner support layer 31. The second outer support layer 32 is fixed to a plurality of peaks 22A of the second inner support layer 22 to thereby reinforce the second inner support layer 22. With the inner and outer support layers adhered to one another in this manner, the tubes 10 and support layers comprise a unitary structure that is highly resistant to stress and strain. The outer support layers 31, 32 are preferably substantially flat, as shown in FIG. 3, or gently curved, as shown in FIG. 4, so as to enhance the strength of the entire structure by maximizing the angular interaction between the inner 21, 22 and outer 31, 32 support layers.

Figure 6:
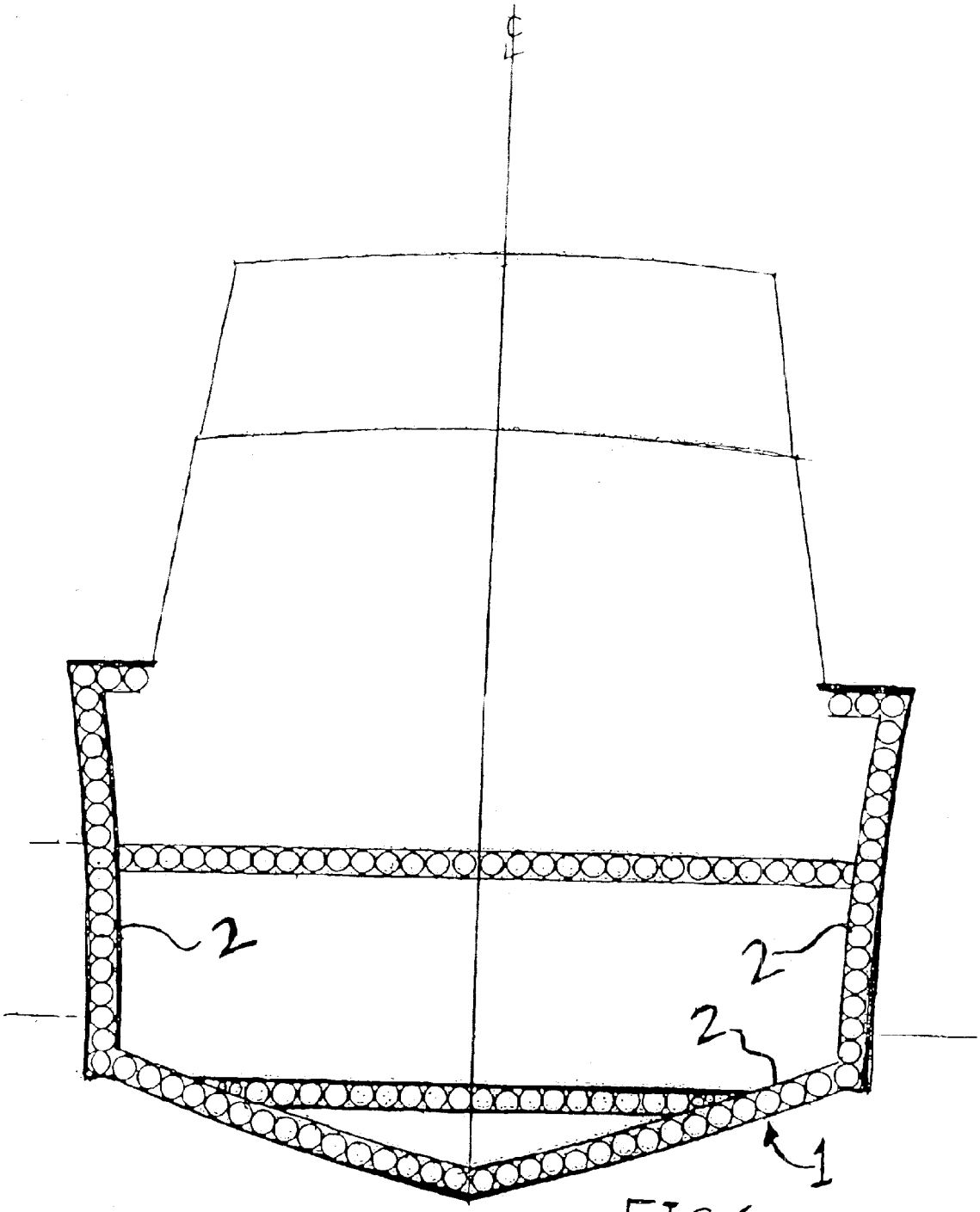
FIG. 6 is a cross-section view of a motor yacht hull constructed using the wall construction of the invention, and featuring internal structural flooring and bulkheads constructed using the wall construction of the invention.
Figure 7:
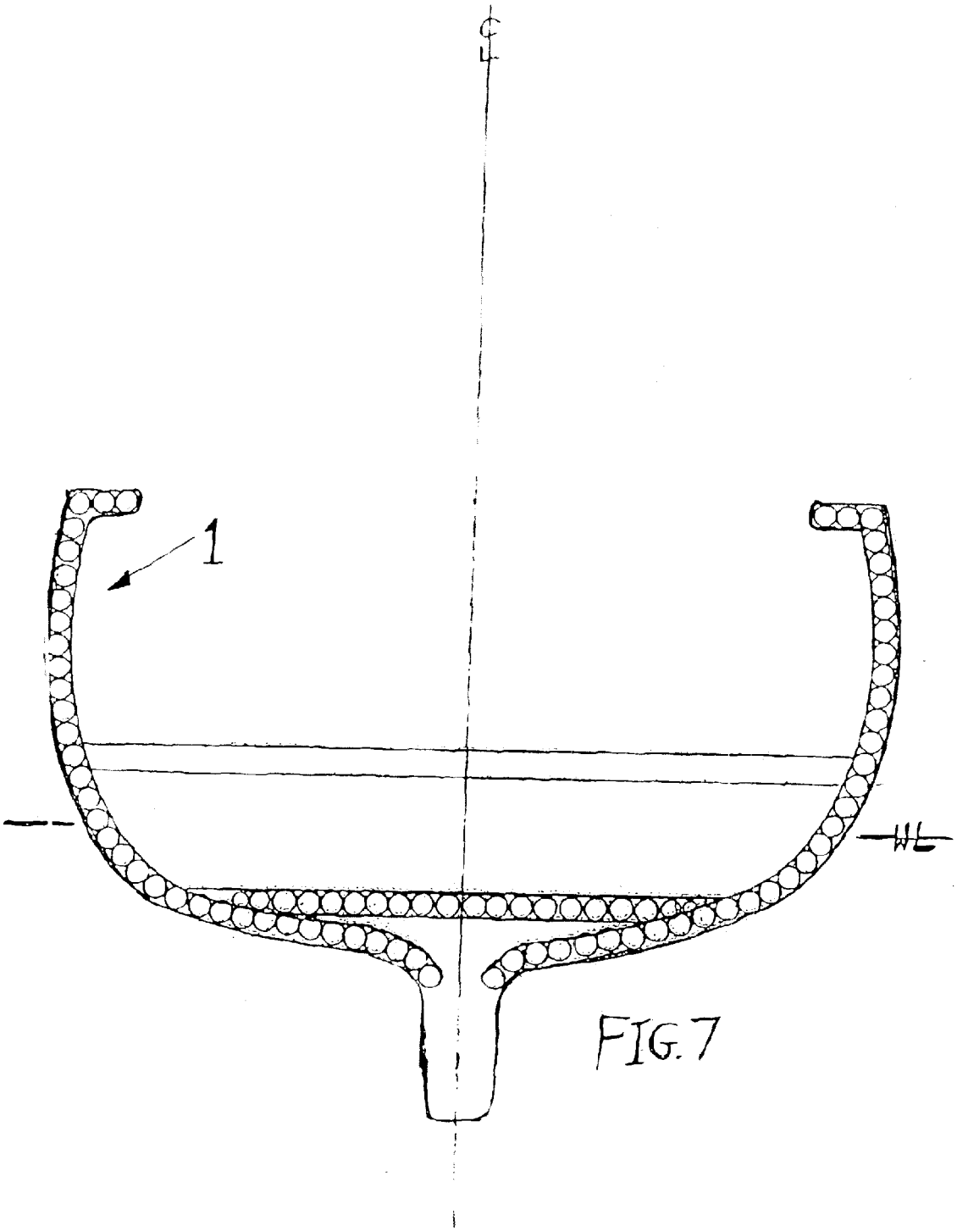
FIG. 7 is a cross-section view of a sail boat hull constructed using the wall construction of the invention, and featuring an internal floor or bulkhead constructed using the wall construction of the invention.
Figure 8A:
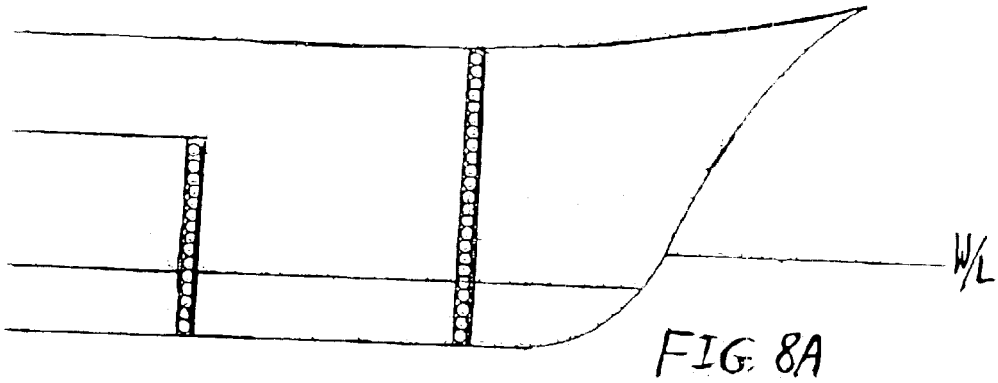
FIG. 8A is a bow half of a ship having internal bulkheads constructed using the wall construction of the invention.
Figure 8B:
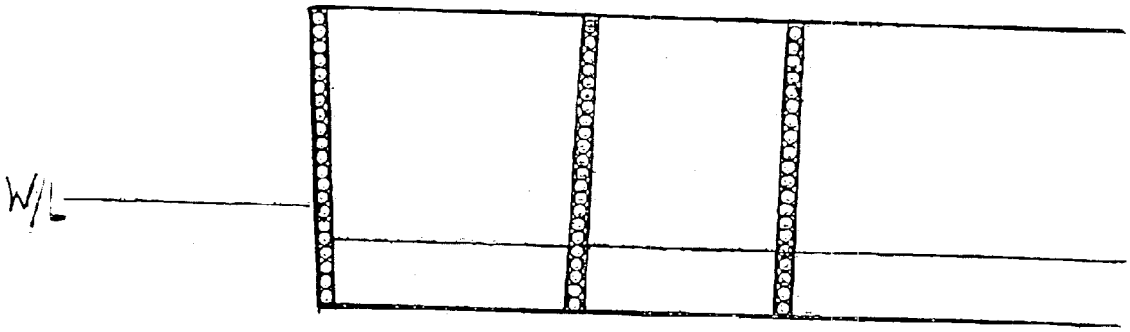
FIG. 8B is a stern half of a ship having internal bulkheads constructed using the wall construction of the invention.

Together, the tubes 10, the first and second inner support layers 21, 22, and the first and second outer support layers 31, 32 form the integrated, compartmentalized, water impermeable hull, as shown in FIGS. 6–8. As shown in FIG. 6, the hull may be constructed from a plurality of integrated, compartmentalized, water impermeable barriers 2 of the type described above, with the individual barriers 1 fixedly joined together to form the hull. The invention essentially provides a compartmentalized, integrated double hull 1 that is highly resistant to puncture.

The tubes 10 are preferably polymer tubes of the type readily available in hardware and plumbing stores, namely PVC tubes (polyvinyl chloride) or ABS (a copolymer of acrylonitrile, butadiene, and styrene) tubes. Other types of tubes, such as plastic tubes, can be used, provided that they have sufficient strength, stiffness, and durability for the applications in which the water impermeable barrier 1 will be used. Metal pipes could be used to construct impermeable barriers 1 according to the techniques of the invention, but it is believed that metal is too expensive and heavy to be used as the sole tube material in most applications of the invention. An occasional metal pipe could be used as a component tube of a water impermeable barrier 1 constructed primarily of PVC tubes, particularly in situations where it is desirable to run a particular component through a metal pipe rather than a PVC tube.

The fiber-resin materials used to construct the wall unit of the invention 1 are of the type used in conventional boat building, and the fiber-resin materials are applied using conventional fiber-resin application techniques. The fibrous material is preferably kevlar, carbon, or fiberglass. The resin is preferably epoxy, polyester, or vinylester.

In most applications of the invention, the strength of the PVC tubes is not a determining factor in the strength, stiffness and durability of the wall unit 1, as these characteristics are provided primarily by the inner 21, 22 and outer 31, 32 reinforcement layers. Rather, the PVC tubes provide a number of benefits over conventional core materials, such as foam or balsa wood. PVC tubes are inexpensive, yet very durable over a long period of time. When plugged on either end, PVC tubes provide a plurality of self-floating compartments, thus making the vessel virtually unsinkable. PVC tubes can be telescoped together to provide tubes of virtually any desired length. PVC tubes come in a variety of readily available diameters. Different diameters of PVC tubes can be selected, depending on the desired characteristics of the wall unit. PVC tubes of a given diameter are of a uniform character, which makes them easy to work with and facilitates the construction of water impermeable structural barriers 2 having a uniform core thickness. As described herein, the hollow interiors of the PVC tubes 10 provide various useful options for running electric wiring, water lines, air conditioning ducts, heating ducts, and the like in the hull of a vessel. Additionally, the double-walled, compartmentalized construction of the invention 1 provides natural sound dampening and temperature insulation properties, which make it useful for internal walls. The temperature insulation properties of the core minimize or prevent condensation from building up along the interior side of the hull, thus avoiding problems associated with condensation, such as rotting of interior paneling.

Flexing of components relative to one another is a perpetual problem in marine constructions. As components flex over time under the action of waves and surface use, they tend to fail. The wall construction technique taught in this invention reduces or eliminates flex, providing a construction that is largely immune to the problems caused by flexing.

The various inner and outer reinforcing layers can be of varying thickness depending on the degree of strength, stiffness, and puncture resistance that is desired. The inner support layers 21, 22 are preferably somewhat thinner than the outer support layers 31, 32. When using fiberglass on boats up to 30 to 40 feet in length, the outer support layers 31, 32 are preferably about ⅛ inch thick. For boats of about 40 to 50 feet in length, the outer support layers 31, 32 are preferably about ¼ inch thick. For boats 75 to 100 feet in length, the outer support layers are preferably about ⅜ to ½ inch thick. Prior art composite walls are typically a maximum of about 2.5 cm (1 inch) thick. By using large PVC tubes, the present invention can be used to create integrated double hulls of 20 cm (8 inches) or more, depending on the diameter of the PVC tubes and the thickness of fiberglass used. The support layers may be varied at different locations on the boat, e.g. thicker below the waterline, in accordance with conventional naval architecture principles.

Figure 9:
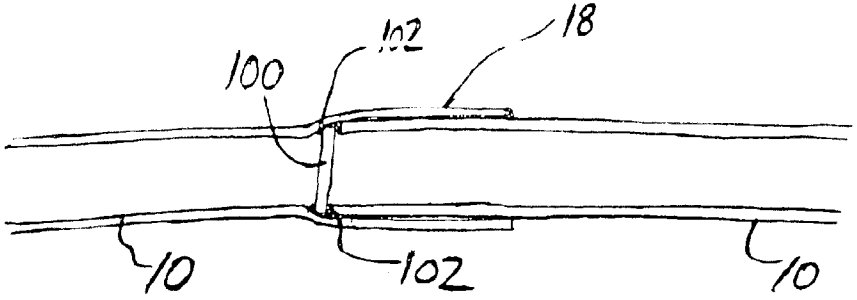
FIG. 9 shows a pair of tubes joined together and compartmentalized via a baffle member.
Figure 10:
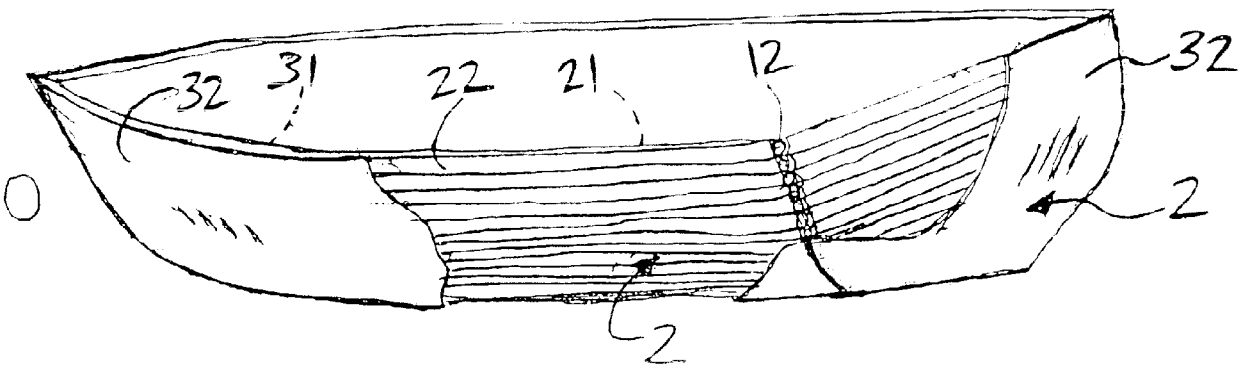
FIG. 10 shows a partial cutaway view of a hull constructed according to the invention, with a partial cutaway showing details of the inner support layer and the joining of a pair of compartmentalized barriers to form the tubular, integrated, compartmentalized hull.

FIG. 9 shows a pair of tubes 10 that have been joined together end-to-end. PVC tubes are available in various lengths, typically of about 6 meters (20 feet) or less. When building lengthy vessels, such as ocean going yachts, it may be useful or necessary to join a plurality of PVC tubes together end-to-end, so as to form an elongated length of PVC tube of 20 meters or more. PVC tubes are conventionally provided with one flared or bell end 18, as shown in FIG. 9, for use in joining PVC tubes together. The flared end 18 has as an inner diameter sized to tightly receive the outer diameter of a PVC tube of the same size. FIG. 9 shows the use of a baffle member 100, which provides compartmentalization when working with tubes joined end-to-end. The baffle member 100 is preferably a thin disc of about 2 to 7 mm (about 1/16 to ¼ inches) in thickness and having a diameter sized to seal the tubes. Before the baffle member 100 is inserted into the flared end 18, an adhesive 102 such as epoxy or PVC glue is preferably applied around the baffle member 100 to secure it in place. The baffle member 100 can be omitted if compartmentalization is not desired, e.g. if water, electric lines, or telecommunications cables will be run through the tubes 10. In order to align lengthened tubes in a substantially parallel relation, the flared ends 18 can be readily ground down to the level of the outer diameter of the tubes. In general, PVC tubes can be readily ground down as needed to fit a tube into a particular configuration on the boat.

To further improve the buoyancy of a vessel, virtually the entire vessel can be built of wall units described herein, i.e. hull, decks, bulkheads, soles, deckhouses, interior walls etc.

The PVC tubes 10 can be made to conform to virtually any curvature, using conventional boat building techniques, such as permanent or removable internal bulkheads. For extreme curvatures, the PVC tubes 10 can be heated before being locked into position by the first and second inner support layers 21, 22.

The invention offers not only a superior hull construction technique, but also several construction advantages over conventional vessel hulls. As mentioned above, the self-contained PVC tubes 10 provide a structure that is virtually unsinkable. Additionally, all of a vessel's wiring, telecommunications cables, water lines, air conditioning and heating ducts, hydraulic and mechanical flexible shaft cables can be run directly through the PVC tubes 10, thus incorporating these components into the wall construction 1.

The cores of the PVC tubes 10 can be used for the tankage of all liquids, e.g. potable water, fuel, oils (hydraulic), and waste (holding). In conventional tanks, a single puncture of the tank can result in loss of all of the contents of the tank. By distributing the contents in multiple self contained PVC tubes, the risk of complete loss of contents is greatly diminished. By using the PVC tubes for potable water tankage, water storage tanks and external plumbing can be eliminated from a vessel. The location, diameter, and quantity of PVC tubing used for tankage should be designed to benefit ballasting of the vessel. On sail boats, the PVC tubes can be used to carry and transfer water ballast quickly and efficiently, e.g. from port to starboard.

The invention other safety benefits in addition to fail-safe buoyancy. For example, PVC tubes carrying electrical wiring can be constructed of heat resistant material. Nozzles can be provided on tubes carrying electrical wiring so that the tubes can be flooded with water or a fire extinguishing gas in the event of a fire. Fire extinguisher systems can also be incorporated into the tubing.

The invention provides esthetic and space saving benefits, since most or all wiring, tankage, and duct work can be incorporated into the integral structure of the vessel. The interior of a vessel constructed according to the invention is completely clean, which allows for much greater flexibility with regard to the design and use of interior space.

The invention provides considerable cost savings over conventional vessel hull core materials. PVC tubes cost only a fraction of the amount of foams and balsa wood. Additionally, further cost savings are realized by using the tubes to eliminate tankgage, duct work, waterlines, and bundling of wire harnesses, as mentioned above.

Method of Construction

The integrated, compartmentalized, water impermeable barrier 2 of the invention can be constructed using the following steps. First, a plurality of tubes are laid parallel to one another, with the outer surfaces of each tube 10 abutting against an outer surface of at least one adjacent tube 10. When forming curved barriers, such as for a boat hull, the tubes 10 are bent around temporary or permanent bulkheads or frames in order to form the desired degree of curvature, in a manner known to those of skill in the art. In order to form compound or extreme curvatures, it may be necessary to heat the tubes 10 in order to bend them into the desired shape.

The most important stage in preparing the integrated, compartmentalized barrier 2 of the invention 1 is the formation of the first 21 and second 22 inner reinforcement layers. The outer surface of the PVC tubes 10 are preferably washed with acetone prior to applying fiberglass. Acetone scuffs or etches the tubing, which allows the resin to form a better bite on the tubing. Polyester and vinylester resin require a good bite on the surface to which they adhere. Epoxies adhere better than polyester resins, but are more expensive. Vinylester resin adheres better than polyester and is less expensive than epoxy.

As shown in FIG. 2, layers of fiber-resin are undulated over the tube 10 barrier to form the first inner support layer 21. Layers of fiber-resin are also undulated over the opposite side of the tube 10 barrier to form a second inner support layer 22. As shown in FIG. 2, the first and second support layers 21, 22 are formed so that they surround and tightly adhere to the tubes 10, thereby holding the tubes 10 in a fixed configuration. When formed in this manner, the inner support layers 21, 22 have opposing peaks 21A, 22A.

As shown in FIG. 3, layers of fiber-resin 31 are laid over the peaks 21A of the first inner support layer 21 to form the first outer support layer 31. Layers of fiber-resin are likewise laid over the peaks 22A of the second support layer 22 to form the second outer support layer 32.

The layers of fiber-resin are applied a manner well known to those of skill in the art. The number of layers of fiber-resin layers used to form the inner 21, 22 and outer 31, 32 support layers will vary depending on the desired level of strength, stiffness, and resistance to punctures of the hull 1 or barrier unit 2, as well as cost considerations. The less fiber-resin used, the less expensive the boat is to construct.

The open ends of the PVC tubes 10 are selectively sealed in order to ensure compartmentalization. A preferred sealant is polyurethane foam, which is inexpensive and easy to apply. All of the components necessary to construct the invention can be obtained from conventional plumbing supply distributors. Specialized fibers and resins can be obtained from marine supply specialists.

The invention has been described primarily in terms of vessel construction, a use for which the invention is particularly well suited. However, it will be appreciated that the basic compartmentalized, integrated, water-impermeable wall unit barriers 2 of the invention 1 can be used in virtually any application in which walls or support structures are required. The wall construction of the invention would also be particularly suited to forming the drilling platform of an oil rig, due to its inherent buoyancy. The double walled, compartmentalized structure of the invention also makes it suitable for use in forming storage tanks.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. An integrated, compartmentalized, water impermeable hull for a boat or other water vessel, said hull comprising:

a plurality of lengthwise tubes, an outer surface of each said tube abutting an outer surface of at least one other of said tubes, said tubes sandwiched between a first inner support layer and a second inner support layer, each said inner support layer undulating along and fixedly adhered to said tubes to thereby hold said tubes in a fixed relation to one another, a first outer support layer positioned over said first inner support layer, said first outer support layer fixed to a plurality of peaks of said first inner support layer to thereby reinforce said first inner support layer, a second outer support layer positioned over said second inner support layer, said second outer support layer fixed to a plurality of peaks of said second inner support layer to thereby reinforce said second inner support layer, and said tubes, said first and second inner support layers, and said first and second outer support layers together configured to form the integrated, compartmentalized, water impermeable hull.

2. The hull of claim 1, wherein said tubes are PVC tubes.

3. The hull of claim 1, wherein said tubes are ABS tubes.

4. The hull of claim 1, wherein said first and said second inner support layers and said first and said second outer support layers consist of a fiber-resin laminate, said fiber-resin laminate having a fiber component and a resin component.

5. The hull of claim 4, wherein said fiber component of said fiber-resin laminate is selected from the group consisting of fiberglass, kevlar, and carbon, and said resin component of said fiber-resin laminate is selected from the group consisting of epoxy, polyester, and vinylester.

6. The hull of claim 1, wherein said undulations form an angle of between about 120 degrees and about 150 degrees relative to one another.

7. The hull of claim 1, wherein said plurality of tubes have open ends sealed with polyurethane foam to thereby increase the buoyancy and safety of the hull in the event of a puncture of the hull.

8. The hull of claim 1, wherein at least some of said tubes are joined end-to-end to thereby form a lengthened barrier.

9. The hull of claim 8, wherein a baffle member is inserted between at least a pair of said end-to-end tubes, said baffle member compartmentalizing said end-to-end tubes into adjacent compartments to thereby increase the buoyancy and safety of the hull in the event of a puncture of the hull.

10. An integrated, floatable, water impermeable hull for a boat or other water vessel, said hull comprising:

a plurality of water impermeable barriers, each said barrier comprising:

a plurality of lengthwise tubes aligned in a generally parallel relation to one another, an outer surface of each said tube abutting an outer surface of at least one other of said tubes, said tubes sandwiched between a first inner support layer and a second inner support layer, each said inner support layer undulating along and fixedly adhered to said tubes to thereby hold said tubes in a fixed relation to one another, a first outer support layer positioned over said first inner support layer, said first outer support layer fixed to a plurality of peaks of said first inner support layer to thereby reinforce said first inner support layer, a second outer support layer positioned over said second inner support layer, said second outer support layer fixed to a plurality of peaks of said second inner support layer to thereby reinforce said second inner support layer, and said plurality of water impermeable barriers fixedly joined to one another to thereby form the integrated, floatable, water impermeable hull.

11. The hull of claim 10, wherein said tubes are PVC tubes.

12. The hull of claim 10, wherein said tubes are ABS tubes.

13. The hull of claim 10, wherein said first and said second inner support layers and said first and said second outer support layers consist of a fiber-resin laminate, said fiber-resin laminate having a fiber component and a resin component.

14. The hull of claim 13, wherein said fiber component of said fiber-resin laminate is selected from the group consisting of fiberglass, kevlar, and carbon, and said resin component of said fiber-resin laminate is selected from the group consisting of epoxy, polyester, and vinylester.

15. The hull of claim 10, wherein said undulations form an angle of between about 120 degrees and about 150 degrees relative to one another.

16. The hull of claim 10, wherein said plurality of tubes have open ends sealed with polyurethane foam to thereby increase the buoyancy and safety of the hull in the event of a puncture of the hull.

17. The hull of claim 10, wherein at least some of said tubes are joined end-to-end to thereby form a lengthened barrier.

18. The hull of claim 17, wherein a baffle member is inserted between at least a pair of said end-to-end tubes, said baffle member compartmentalizing said end-to-end tubes into adjacent compartments to thereby increase the buoyancy and safety of the hull in the event of a puncture of the hull.

19. A method of constructing a tubular, integrated, compartmentalized, water impermeable barrier particularly suited for use in constructing boats, comprising:

providing a plurality of lengthwise tubes, arranging said tubes in a generally parallel relationship to one another, such that an outer surface of each said tube abuts an outer surface of at least one other of said tubes, undulating a fiber-resin layer over a first side of said tubes to thereby form a first inner support layer, undulating a fiber-resin layer over a second side of said tubes to thereby form a second inner support layer, whereby said first and said second inner support layers hold said tubes in a fixed relation to one another, forming a fiber-resin layer over a plurality of peaks of said first inner support layer to thereby form a first outer support layer, said first outer support layer providing reinforcement for said first inner support layer, and forming a fiber-resin layer over a plurality of peaks of said second inner support layer to thereby form a second outer support layer, said second outer support layer providing reinforcement for said second inner support layer.

20. The method of claim 19, further comprising washing an outer surface of said tubes with acetone prior to applying said fiber resin layers.

21. The method of claim 19, wherein said tubes are PVC tubes.

22. The method of claim 19, wherein said tubes are ABS tubes.

23. The method of claim 19, wherein said undulations form an angle of between about 120 degrees and about 150 degrees relative to one another.

24. The method of claim 19, further comprising sealing open ends of at least some of said plurality of tubes with polyurethane foam to thereby increase the buoyancy and safety of the hull in the event of a puncture of the hull.

25. The method of claim 19, wherein each said fiber-resin layer has a fiber component and a resin component, said fiber component of said fiber-resin layers is selected from the group consisting of fiberglass, kevlar, and carbon, and said resin component of said fiber-resin layers is selected from the group consisting of epoxy, polyester, and vinylester.

26. A boat constructed according to the method of claim 19.

* * * * *